US009574281B2

(12) United States Patent
Dewaki

(10) Patent No.: US 9,574,281 B2
(45) Date of Patent: Feb. 21, 2017

(54) SILVER-CONTAINING ALLOY PLATING BATH AND METHOD FOR ELECTROLYTIC PLATING USING SAME

(71) Applicants: Teru Matsuura, Tokyo (JP); Shinji Dewaki, Nagoya-shi (JP)

(72) Inventor: Kenji Dewaki, Nagoya (JP)

(73) Assignee: M-TECH JAPAN CO., LTD., Tokyo (JP)

( * ) Notice: Subject to any disclaimer, the term of this patent is extended or adjusted under 35 U.S.C. 154(b) by 236 days.

(21) Appl. No.: 14/269,917

(22) Filed: May 5, 2014

(65) Prior Publication Data

US 2014/0238866 A1 Aug. 28, 2014

Related U.S. Application Data

(62) Division of application No. 13/147,901, filed as application No. PCT/JP2009/052088 on Feb. 6, 2009, now abandoned.

(51) Int. Cl.

| | |
|---|---|
| ***C25D 3/56*** | (2006.01) |
| ***C25D 3/46*** | (2006.01) |
| ***C25D 3/64*** | (2006.01) |

(52) U.S. Cl.

CPC . *C25D 3/46* (2013.01); *C25D 3/56* (2013.01); *C25D 3/64* (2013.01); *Y10T 428/12493* (2015.01)

(58) Field of Classification Search

CPC ..... C25D 3/64
USPC ..... 205/238
See application file for complete search history.

(56) References Cited

U.S. PATENT DOCUMENTS

| | | | | |
|---|---|---|---|---|
| 4,477,318 | A * | 10/1984 | Tomaszewski | C25D 3/06 204/DIG. 13 |
| 4,478,691 | A | 10/1984 | Abys | |
| 6,361,742 | B2 | 3/2002 | Takeda et al. | |
| 7,214,409 | B1 | 5/2007 | Kasule | |
| 8,653,375 | B2 | 2/2014 | Osenbach | |
| 2003/0159938 | A1 | 8/2003 | Hradil | |
| 2004/0020567 | A1 | 2/2004 | Baldwin | |
| 2009/0046566 | A1 | 2/2009 | Fujii et al. | |
| 2010/0000873 | A1 | 1/2010 | Imanari et al. | |
| 2012/0208044 | A1 | 8/2012 | Dewaki et al. | |

FOREIGN PATENT DOCUMENTS

| | | |
|---|---|---|
| EP | 1 024 211 A2 | 8/2000 |
| EP | 1 617 427 A2 | 1/2006 |
| EP | 1 889 932 A1 | 2/2008 |
| JP | A-62-218595 | 9/1987 |
| JP | A-62-218596 | 9/1987 |
| JP | A-5-287542 | 11/1993 |
| JP | H07-34211 A | 2/1995 |
| JP | A-8-176883 | 7/1996 |
| JP | A-2000-76948 | 3/2000 |
| JP | A-2002-167676 | 6/2002 |
| JP | A-2002-226927 | 8/2002 |
| JP | A-2004-113950 | 4/2004 |
| JP | A-2005-5716 | 1/2005 |
| JP | A-2007-111898 | 5/2007 |
| JP | A-2008-51840 | 3/2008 |
| JP | A-2008-88477 | 4/2008 |
| JP | A-2008-194689 | 8/2008 |
| JP | A-2008-280559 | 11/2008 |
| TW | 200728479 A | 8/2007 |
| TW | 201006966 A1 | 2/2010 |

OTHER PUBLICATIONS

Nov. 25, 2014 Office Action issued in U.S. Appl. No. 13/386,805.
Yasui et al.; "A Sulfuration Gas Test for Chip Components With Solder Plating on Silver Termination;" *Journal of Reliability Engineering Association of Japan*; 2002; pp. 761-766; vol. 24, No. 8 (with Abstract).
International Search Report dated May 19, 2009 in International Application No. PCT/JP2009/052088.
Gschneldner, Jr. et al., "The Ag-Gd (Silver-Gadolinium) System," *Bulletin of Alloy Phase Diagrams*, 1985, pp. 138-140, vol. 6, No. 2.
Office Action issued in Taiwanese Patent Application No. 99103335 dated Dec. 17, 2012 (with partial translation).
Extended European Search Report issued in European Application No. 09 83 9659.1 dated Jan. 9, 2013.
Hodge et al.; "Stresses in Thin Film Metallization;" *IEEE Transactions on Components, Packaging, and Manufacturing Technology—Part A*; Jun. 1997; pp. 241-250; vol. 20, No. 2.
Hwang et al.; "Evolutions of Surface Morphologies in Sputtered and Electroplated Cu Films During Thermal Cycling;" *Material Science Forum*; 2002; pp. 1651-1656; vols. 408-412.
Hoshi et al.; "Properties of Electroplated Aluminum Thin Films;" *Hitachi Kinzoku Gihou*; 2011; pp. 20-27; vol. 27 (with partial English-language translation).
Taiwanese Office Action dated Jan. 8, 2013 from Taiwanese Patent Appplication No. 99125437 (with English-language translation).
Taiwanese Search Report dated Jan. 3, 2013 from Taiwanese Patent Application No. 99125437 (with English-language translation).
International Search Report dated Nov. 10, 2009 from International Application PCT/JP2009/063691 (with English-language translation).
Official Notice of Rejection dated Aug. 27, 2013 from Japanese Patent Application No. 2010-549284 (with English-language translation).
Notification of the First Office Action dated Dec. 2, 2013 from Chinese Patent Application No. 200980160631.7 (with English-language translation).

* cited by examiner

*Primary Examiner* — Edna Wong

(57) ABSTRACT

A silver-containing alloy electrolytic plating bath that can produce silver-containing alloy plated products having excellent resistance to oxidation suitable for electronic members, decoration members, and dental members, is described, along with a method for electrolytic plating using the same. The silver-containing alloy plated products have excellent resistance to oxidation and can be manufactured by using the plating bath that contains (a) a silver compound containing 99.9% to 46% by mass of silver on the basis of the total metal mass therein, (b) a gadolinium compound containing 0.1% to 54% by mass of gadolinium on the basis of the total metal mass therein, (c) at least one kind of complexing agent, and (d) a solvent.

8 Claims, No Drawings

SILVER-CONTAINING ALLOY PLATING BATH AND METHOD FOR ELECTROLYTIC PLATING USING SAME

The present application is a divisional application of U.S. application Ser. No. 13/147,901 filed Aug. 4, 2011, now abandoned, which in turn is a U.S. national phase application of PCT/JP2009/052088 filed Feb. 6, 2009. The disclosure of each of these prior applications is incorporated herein by reference in its entirety.

TECHNICAL FIELD

The present invention relates to a silver-containing alloy electrolytic plating bath which can produce silver-containing alloy plated products suitable for electronic members, decoration members, and dental members, to a method for electrolytic plating using the same, and to a substrate on which the electrolytic plating is deposited.

BACKGROUND ART

Silver has a beautiful white gloss or non-gloss, and is used in tableware, ornaments, arts and crafts, and the like. Since silver has highest electric conductivity among metals, silver plating is applied to the surface of metals in electric parts including contacts, automobile parts, aircraft parts, and the like. (For example, refer to Japanese Patent Laid-Open No. 2000-76948 (Patent Document 1) and to Japanese Patent Laid-Open No. H05-287542 (1993) (Patent Document 2).)

On the other hand, silver is likely to be oxidized and tends to generate whiskers on the surface of silver plating. Accordingly, along with high density mounting of electronic parts in recent years, the silver-plated products raise serious problems of contact resistance failure and electrical short circuit resulted from the generation of whiskers and the surface oxidation. (For example, refer to Journal of Reliability Engineering Association of Japan, vol. 24, No. 8, pp. 761-766, (2002) (Non-patent Document 1).)

Regarding the above problems, persons skilled in the art sought measures to prevent the generation of whiskers on silver-plated products. Until now, however, no satisfactory suppression of whisker generation is achieved through the studies of plating bath and/or electrolytic plating method. Currently, therefore, gold plating is very often used, which is more expensive than silver, though the generation of whiskers is less and the electric conductivity is good. (For example, refer to Japanese Patent Laid-Open No. 2005-005716 (Patent Document 3) and Japanese Patent Laid-Open No. 2002-167676 (Patent Document 4).)

[Patent Document 1] Japanese Patent Laid-Open No. 2000-076948

[Patent Document 2] Japanese Patent Laid-Open No. H05-287542 (1993)

[Patent Document 3] Japanese Patent Laid-Open No. 2005-005716

[Patent Document 4] Japanese Patent Laid-Open No. 2002-167676

[Non-patent Document 1] Journal of Reliability Engineering Association of Japan, vol. 24, No. 8, pp. 761-766, (2002)

DISCLOSURE OF THE INVENTION

Technical Problem

The present invention has been perfected to solve the above problems, and an object of the present invention is to provide a silver-containing alloy electrolytic plating bath which can prevent surface oxidation of the obtained silver-containing alloy plated product and can suppress the generation of whiskers, to provide a method for electrolytic plating using the same, and to provide a substrate on which the electrolytic plating is deposited. Another object of the present invention is to provide the silver-containing alloy plated product obtained by the method of the present invention with physical and electrical characteristics equivalent to those of gold-plated products.

Technical Solution

The present invention provides a silver-containing alloy electrolytic plating bath which can produce silver-containing alloy plated products having excellent resistance to oxidation suitable for electronic members, decoration members, and dental members, to a method for electrolytic plating using the same, and to a substrate on which the electrolytic plating is deposited.

Specifically the plating bath is to deposit a silver-containing alloy on the surface of the substrate. The silver-containing alloy plated products having excellent resistance to oxidation can be manufactured by using the plating bath which contains (a) a silver compound containing 99.9% to 46% by mass of silver on the basis of the total metal mass therein, (b) a gadolinium compound containing 0.1% to 54% by mass of gadolinium on the basis of the total metal mass therein, (c) at least one kind of complexing agent, and (d) a solvent, and by using the method for electrolytic plating applying the plating bath.

Effect of the Invention

The electrolytic plating method using the silver-containing alloy plating bath of the present invention can provide a silver-containing alloy plated product which prevents the surface oxidation and suppresses the generation of whiskers. Furthermore, thus obtained silver-containing alloy plated product has a hardness of Vickers 60 to 180 on the surface thereof and has a surface contact resistance at a comparable level to that of gold, thus the silver-containing alloy plated product can also be used as a substitute for gold-plated products.

BEST MODE FOR CARRYING OUT THE INVENTION

The modes for carrying out the invention are described in the following. The embodiments given below are simply examples of the present invention, and a person skilled in the art can modify the design adequately.

(Plating Bath)

The plating bath according to the present invention contains (a) a silver compound containing 99.9% to 46% by mass of silver on the basis of the total metal mass therein, (b) a gadolinium compound containing 0.1% to 54% by mass of gadolinium on the basis of the total metal mass therein, (c) at least one kind of complexing agent, and (d) a solvent.

a. Silver Compound

The silver compound according to the present invention is arbitrary compound if only the compound can be dissolved in a solvent solely or together with a complexing agent described below, thus providing silver ions. In the present invention, applicable sliver compounds are silver salts such as silver chloride, silver bromide, silver sulfate, silver sulfite, silver carbonate, organic silver sulfonate, silver sulfosuccinic acid, silver nitrate, silver citrate, silver tartrate, silver gluconate, silver oxalate, and silver oxide, and arbitrary soluble salts containing these salts, though not limited to them. As of these, salts with organic sulfonate are preferred.

The silver ions provided from a silver compound exist in the plating bath of the present invention by amounts from 99.9% to 46% by mass on the basis of the total metal mass in the plating bath. Preferably these silver ions may exist by amounts from 99.7% to 50% by mass, more preferably from 99.7% to 60% by mass, and most preferably from 99.7% to 70% by mass.

The concentration of total metal ions in the plating bath is in a range from 0.01 to 200 g/L, and preferably from 0.5 to 100.0 g/L. Normally the silver ions exist in the plating bath by amounts from 20 to 200 g/L, and preferably from 25 to 80 g/L.

b. Gadolinium Compound

The gadolinium compound according to the present invention is arbitrary compound if only the compound can be dissolved in a solvent solely or together with a complexing agent described below, thus providing gadolinium ions. In the present invention, applicable gadolinium compounds include gadolinium salt such as gadolinium nitrate, gadolinium oxide, gadolinium sulfate, gadolinium chloride, and gadolinium phosphate, and a mixture thereof, though not limited to them. Among these, gadolinium oxide is preferred.

The gadolinium ions provided from a gadolinium compound exist in the plating bath of the present invention by amounts from 0.1% to 54% by mass on the basis of the total metal mass in the plating bath. Preferably these gadolinium ions may exist by amounts from 0.3% to 50% by mass, more preferably from 0.3% to 40% by mass, and most preferably from 0.3% to 30% by mass. If the amount of gadolinium ions is smaller than 0.1% by mass, the whisker generation from the obtained silver-containing alloy plated product cannot fully be suppressed. On the other hand, if the amount of gadolinium ions is 54% by mass or larger to the total mass of the metal, the electric conductivity deteriorates. Generally the gadolinium ions exist in the plating bath by amounts from 0.01 to 5.0 g/L, preferably from 0.1 to 5.0 g/L.

c. Complexing Agent

The complexing agent is a compound that coordinates with the silver ions and/or the gadolinium ions, supplied from the above silver compound and/or gadolinium compound, thus stabilizing the ions. According to the present invention, the complexing agent may have two or more metal-coordinating sites.

Applicable complexing agents in the present invention include: amino acid having 2 to 10 carbon atoms; polycarboxylic acid such as oxalic acid, adipic acid, succinic acid, malonic acid, and maleic acid; aminoacetic acid such as nitrilotriacetate; alkylene polyamine polyacetate such as ethylenediamine tetraacetate (EDTA), diethylenetriamine pentaacetate (DTPA), N-(2-hydroxyethyl)ethylenediamine triacetate, 1,3-diamino-2-propanol-N,N,N',N'-tetraacetate, bis-(hydroxyphenyl)-ethylenediaminediacetate, diaminocyclohexane tetraacetate, and ethyleneglycol-bis-((β-aminoethylether)-N,N'-tetraacetate); polyamine such as N,N,N',N'-tetrakis-(2-hydroxypropyl)ethylene diamine, ethylenediamine, 2,2',2"-triaminotriethylamine, trimethylenetetramine, diethylenetriamine, and tetrakis(aminoethyl) ethylenediamine; citrate; tartrate; N,N-di-(2-hydroxyethyl) glycine; gluconate; lactate; crown ether; cryptand; polyhydroxyl group compound such as 2,2',2"-nitrilotrietha-nol; hetero aromatic compound such as 2,2'-bipyridin, 1,10-phenanthroline, and 8-hydroxyquinoline; thio-containing ligand such as thioglycol acid with diethyldithiocarbamate; and amino alcohol such as ethanolamine, diethanolamine, and triethanolamine, though not limited to them. Above complex agents may be used in combination of two or more of them.

The complex agent in the present invention can be used at various concentrations. For example, to the total amount of silver ions and/or gadolinium ions existing in the plating bath, the complex agent can be used at an amount of stoichiometric equivalent to or of excess to the stoichiometric equivalent so as to complex all the silver ions and/or gadolinium ions. The term "stoichiometric" referred to herein signifies "equimolar" as used herein.

The complexing agent may exist in the plating bath at a concentration ranging from 0.1 to 250 g/L. Preferably the complexing agent exists in the plating bath at an amount from 2 to 220 g/L, and more preferably from 50 to 150 g/L.

d. Solvent

The solvent in the plating bath of the present invention may be the one that can dissolve above silver compound, gadolinium compound, and complexing agent. Applicable solvent includes water and non-aqueous solvent such as acetonitrile, alcohol, glycol, toluene, and dimethylformamide. A preferred solvent includes the one from which other metal ions are removed by an ion-resin and the like. Most preferable solvent is water after removing metal ions.

The plating bath of the present invention normally has a pH value ranging from 1 to 14, preferably not more than 7, and more preferably not more than 4. The pH of the plating bath may be maintained at a desired level by adding a buffer thereto. Any compatible acid or base can be used as the buffer, and organic or inorganic compound thereof can be applied. The term "compatible acid or base" means that no precipitation of silver ions and/or complexing agent is generated from the solvent when that kind of acid or base is used at an amount sufficient to buffer the pH. Examples of the buffer are alkali metal hydroxide such as sodium hydroxide and potassium hydroxide, carbonate, citric acid, tartaric acid, nitric acid, acetic acid, and phosphoric acid, though not limited to them.

e. Additive

The plating bath of the present invention can optionally contain known additives such as surfactant, stabilizer, gloss agent, semi-gloss agent, antioxidant, and pH adjustor.

Above surfactant includes: nonionic surfactant prepared by addition condensation of $C_1$-$C_{20}$ alkanol, phenol, naphthol, bisphenols, $C_1$-$C_{25}$ alkylphenol, arylalkylphenol, $C_1$-$C_{25}$ alkylnaphtol, $C_1$-$C_{25}$ alkoxylated phosphoric acid (salt), sorbitan ester, styrenated phenols, polyalkylene glycol, $C_1$-$C_{22}$ aliphatic amine, $C_1$-$C_{22}$ aliphatic amide, and the like with 2 to 300 moles of ethylene oxide (EO) and/or propylene oxide (PO); and various surfactants of cationic, anionic, or amphoteric.

Above-given stabilizer is added aiming to stabilize the liquid or to prevent decomposition of the liquid, and specifically effective ones are known stabilizers such as cyan compound, sulfur-containing compound such as thioureas, sulfite, and acetylcysteine, and oxycarbonates such as citric acid. Furthermore, above-described complexing agents are also useful as the stabilizer.

Above-given gloss agents include: various aldehydes such as m-chlorobenzaldehyde, p-nitrobenzaldehyde, p-hydroxybenzaldehyde, 1-naphtoaldehyde, salicylaldehyde, paraldehyde, acrolein, chlotonaldehyde, glutaraldehyde, and vanillin; ketones such as benzalacetone and acetophenone;

unsaturated carboxylic acid such as acrylic acid, methacrylic acid, and crotonic acid; triazine; imidazole; indole; quinoline; 2-vinylpyridine; and aniline.

Above-given semi-gloss agents include: thioureas; N-(3-hydroxybutylidene)-p-sulfanyl acid; N-butylidenesulfanyl acid; N-cinnamoylidene sulfanilic acid; 2,4-diamino-6-(2'-methylimidazolyl(1'))ethyl-1,3,5-triazine; 2,4-diamino-6-(2'-ethyl-4-methylimdazolyl(1'))ethyl-1,3,5-triazine; 2,4-diamino-6-(2'-undecylimidazolyl(1'))ethyl -1,3,5-triazine; phenyl salcilate, and benzothiazoles such as benzothiazole, 2-methylbenzothiazole, 2-(methylmercapto)benzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, 2-mercaptobenzothiazole, 6-nitro-2 -mercaptobenzothiazole, 5-hydroxy-2-methylbenzothiazole, and 2-benzothiazolethioacetate. Above-given antioxidants include: ascorbic acid or salt thereof; hydroquinone; catechol; resorcin; phloroglucin; cresol sulfonate and salt thereof; phenol sulfonate and salt thereof; and naphtol sulfonate and salt thereof.

Above-given pH adjustors include: various acids such as hydrochloric acid and sulfuric acid; and various bases such as ammonium hydroxide and sodium hydroxide.

(Electrolytic Plating Method)

The present invention provides a method for electrolytic plating, comprising the steps of: immersing a substrate in a plating bath; and applying an electric field to the substrate, wherein the plating bath contains (a) a silver compound containing 99.9% to 46% by mass of silver on the basis of the total metal mass therein, (b) a gadolinium compound containing 0.1% to 54% by mass of gadolinium on the basis of the total metal mass therein, (c) at least one kind of complexing agent, and (d) a solvent. The method for electrolytic plating according to the present invention can use a method widely known to persons skilled in the barrel plating, rack plating, high speed continuous plating, rackless plating, and the like.

a. Substrate

According to the present invention, the substrate allowing the silver-containing alloy to deposit on the surface thereof is the conductive one, which is used as an anode in the electrolytic plating process. The conductive material used as the substrate includes iron, nickel, copper, chromium, tin, zinc, an alloy thereof, and resin substrate treated by the metal or alloy thereof as the metal surface preparation, though not limited to them. Preferable material therefor includes stainless steel, 42 alloy, phosphor bronze, nickel, and brass. Furthermore, the substrate may be subjected to surface treatment to improve the adhesiveness of plating.

b. Electrolysis Condition

According to the method for electrolytic plating of the present invention, the substrate on the surface of which the silver-containing alloy is deposited (plated) is used as the anode. Soluble or preferably insoluble cathode is used as the secondary electrode. In the present invention, there can be applied pulse plating, direct current plating, or combination of pulse plating with direct current plating.

A person skilled in the art can adequately vary the current density and the electrode surface potential in the design of the electrolytic plating process depending on the substrate being plated. Generally cathode current density and anode current density vary in a range from 0.5 to 3 A/cm$^2$, respectively. Generally the temperature of plating bath is maintained in a range from 25° C. to 45° C. during the process of electrolytic plating. To form the deposit of desired thickness, the electrolytic plating process is conducted for a sufficient period. The method according to the present invention can form the silver-containing alloy plating on the surface of substrate at a thickness ranging from 0.01 to 50 μm.

(Substrate on which the Electrolytic Plating is Deposited)

The present invention provides a substrate on which the electrolytic plating is deposited, which electrolytic plating contains (1) 99.9% to 46% by mass of silver on the basis of the total metal mass, and (2) 0.1% to 54% by mass of gadolinium on the basis of the total metal mass.

The silver-containing alloy plating deposited on the surface of the substrate can suppress the surface oxidation and can prevent the generation of whiskers. Furthermore, the silver-containing alloy plating has a hardness of Vickers from 60 to 180.

In addition, the silver-containing alloy plating deposited on the surface of the substrate according to the present invention can have a surface contact resistance at a comparable level to that of gold. The term "surface contact resistance" referred to herein signifies the resistance under applying current in a loaded state. The silver-containing alloy plating according to the present invention can have a surface contact resistance of 1 mΩ or less when 5 A of current is applied under 1000 N of loading.

Although the reason that the silver-containing alloy plating deposited on the surface of the substrate according to the present invention has above-given excellent property of oxidation resistance is not necessarily defined by the theory, a presumable reason is that a silver-containing alloy having a dense crystal structure is formed by the addition of gadolinium.

EXAMPLES

The present invention and the effect of the invention are described below referring to Examples and Comparative Examples. These Examples, however, do not limit the scope of the present invention.

(Heat Resistance Test)

An electrolytically plated substrate was heated to 280° C. for 3 minutes, and the changes appeared on the plating surface were observed. In addition, the heat-treated plating surface was evaluated by the cross-cut method (1 mm of spacing).

(Contact Resistance)

The electrolytically plated substrate was clamped by a pair of terminal electrodes. The contact area between the terminal electrode and the substrate was set to 10 cm$^2$, and the terminal electrode was pressed against the substrate applying 1000 N of force. In that state, a 5.00 A of current was applied between the terminal electrodes, and the potential difference between one terminal electrode and the substrate was determined. Using thus obtained potential difference, the contact resistance was determined.

(Method for Determining the Surface Vickers Hardness)

Using a surface hardness gauge (Model DMH-2, manufactured by Matsuzawa Co., Ltd.), the Vickers hardness was determined in an environment at normal temperature under a loading condition of 0.245 N (25 gF) for 15 seconds.

(Salt Spray Test)

In accordance with JIS H8502, an electrolytically plated substrate was subjected to neutral salt spray test (5%-NaCl aqueous solution). After 1 hour, 24 hours, and 168 hours (1 week) had passed, the condition of plating surface (presence/absence of corrosion) was observed.

(Solder Wettability Test)

In accordance with JIS 23196, an electrolytically plated substrate was subjected to solder wettability test by the wetting balance method. The evaluation was given using the solder bath of: tin-lead eutectic solder (tin:lead=60%:40%) as lead-based solder, and tin-silver-copper solder (M705, tin:silver:copper=96.5%:3%:0.5%, manufactured by Senju Metal Industry Co., Ltd.) as lead-free solder, respectively.

Example 1

A plating bath containing the following-listed components at concentrations given in Table 1 was prepared. Thus prepared plating bath showed strong acidity.

TABLE 1

| | |
|---|---|
| Silver oxide | 35 g/L |
| Isopropanol sulfonate | 150 g/L |
| Diethanolamine | 60 g/L |
| Gloss agent | 5 g/L |
| L-ascorbic acid | 1 g/L |
| Gadolinium oxide | 0.3 g/L |

To an iron-based substrate and a copper-based substrate, electrolytic plating was applied in the above plating bath, respectively. The substrate was immersed in the plating bath at a temperature ranging from 25° C. to 45° C., and current was applied at 0.5 to 3.0 A/dm$^2$ of current density for 2 to 3 minutes using the substrate as the anode, and thus a plated coating of 1 μm in thickness was obtained. The content of gadolinium in thus obtained plated coating was 0.10% by mass on the basis of the total mass of the plated coating.

To thus obtained plated coating, tests were given in terms of heat resistance, contact resistance, Vickers hardness, and salt durability. The results are given in Table 4.

Example 2

A plating bath containing the following-listed components at concentrations given in Table 2 was prepared. Thus prepared plating bath showed strong acidity.

TABLE 2

| | |
|---|---|
| Silver oxide | 35 g/L |
| Isopropanol sulfonate | 120 g/L |
| Diethanolamine | 50 g/L |
| Gloss agent | 5 g/L |

TABLE 2-continued

| | |
|---|---|
| L-ascorbic acid | 1 g/L |
| Gadolinium oxide | 0.5 g/L |

To an iron-based substrate and a copper-based substrate, electrolytic plating was applied in the above plating bath, respectively. The substrate was immersed in the plating bath at a temperature ranging from 25° C. to 45° C., and current was applied at 0.5 to 3.0 A/dm$^2$ of current density for 2 to 3 minutes using the substrate as the anode, and thus a plated coating of 1 μm in thickness was obtained. The content of gadolinium in thus obtained plated coating was 0.30% by mass on the basis of the total mass of the plated coating.

To thus obtained plated coating, tests were given in terms of heat resistance, contact resistance, Vickers hardness, and salt durability. The results are given in Table 4.

Example 3

A plating bath containing the following-listed components at concentrations given in Table 3 was prepared. Thus prepared plating bath showed strong acidity.

TABLE 3

| | |
|---|---|
| Silver oxide | 35 g/L |
| Isopropanol sulfonate | 120 g/L |
| Diethanolamine | 50 g/L |
| Gloss agent | 5 g/L |
| L-ascorbic acid | 1 g/L |
| Gadolinium oxide | 8 g/L |

To an iron-based substrate and a copper-based substrate, electrolytic plating was applied in the above plating bath, respectively. The substrate was immersed in the plating bath at a temperature ranging from 25° C. to 45° C., and current was applied at 0.5 to 3.0 A/dm$^2$ of current density for 2 to 3 minutes using the substrate as the anode, and thus a plated coating of 1 μm in thickness was obtained. The content of gadolinium in thus obtained plated coating was 54.00% by mass on the basis of the total mass of the plating.

To thus obtained plated coating, tests were given in terms of heat resistance, contact resistance, Vickers hardness, and salt durability. The results are given in Table 4.

To the coatings prepared by using the plating baths of Examples 1 to 3 and Comparative Examples 1 to 6, given in Table 4, tests were given in terms of heat resistance, contact resistance, Vickers hardness, and salt durability. The results are given in Table 4.

TABLE 4

| Bath | Substrate | Thickness of plating (μm) | Heat-resistance test 280° C., 3 min | Cross-cut after heat-resistance test | Contact resistance (mΩ) | Surface hardness (HV) | Salt spray test 1 H | 24 H | 168 H |
|---|---|---|---|---|---|---|---|---|---|
| Example 1 (Ag; +0.1% Gd) | Iron-based substrate | 1 | ⊙ | ○ | 0.144 | 66 | ○ | ○ | ○ |
| | Copper-based substrate | 1 | ⊙ | ○ | 0.132 | 66 | ○ | ○ | ○ |
| Example 2 (Ag + 0.3% Gd) | Iron-based substrate | 1 | ⊙ | ○ | 0.152 | 112 | ○ | ○ | ○ |
| | Copper-based substrate | 1 | ⊙ | ○ | 0.148 | 112 | ○ | ○ | ○ |
| Example 3 (Ag + 54% Gd) | Iron-based substrate | 1 | ⊙ | ○ | 0.611 | 177 | ○ | ○ | ○ |
| | Copper-based substrate | 1 | ⊙ | ○ | 0.574 | 177 | ○ | ○ | ○ |
| Comparative Example 1 (solo Ag) | Copper-based substrate | 1 | X | ○ | 0.15 | 57 | X | — | — |

TABLE 4-continued

| Bath | Substrate | Thickness of plating (μm) | Heat-resistance test 280° C., 3 min | Cross-cut after heat-resistance test | Contact resistance (mΩ) | Surface hardness (HV) | Salt spray test 1 H | 24 H | 168 H |
|---|---|---|---|---|---|---|---|---|---|
| Comparative Example 2 (Ag + 0.01% Gd) | Copper-based substrate | 1 | ○ | ○ | 0.144 | 58 | ○ | X | — |
| Comparative Example 3 (Ag + 60% Gd) | Copper-based substrate | 1 | ⊙ | ○ | 0.619 | 138 | ○ | ○ | ○ |
| Comparative Example 4 (solo Au) | Iron-based substrate | 1 | ⊙ | ○ | 0.16 | 59 | ○ | ○ | ○ |
| | Copper-based substrate | 1 | ⊙ | ○ | 0.14 | 59 | ○ | ○ | ○ |
| Comparative Example 5 (solo Zn) | Copper-based substrate | 1 | ○ | ○ | 3.4 | 138 | ○ | ○ | X |
| Comparative Example 6 (Zn + 0.3&Gd) | Copper-based substrate | 1 | ○ | ○ | 1.6 | 140 | ○ | ○ | X |

Regarding the plated coating of sole silver, (Comparative Example 1), there appeared discoloration after the heat-resistance test. On the other hand, Examples 1 to 3, according to the present invention, induced no discoloration or separation of plated coating, and were confirmed to have sufficient heat resistance. As for the salt spray test, corrosion was observed on the plated coating of sole silver, (Comparative Example 1), and on the silver-plated coating containing 0.01% Gd, (Comparative Example 2). To the contrary, the plated coating of the present invention did not generate corrosion even after 1 week.

In addition, the plated coating of the present invention was confirmed to have a contact resistance equivalent to that of gold-plated coating, and have a surface hardness not less than that of the gold-plated coating.

For the zinc-plated coating, even a plated coating containing 0.3% Gd, (Comparative Example 6), showed heat resistance and corrosion resistance equivalent to those of the plated coating containing no Gd, (Comparative Example 5).

Next, solder wettability test was given to the coatings obtained using the plating baths in Examples 1 to 3 and in Comparative Examples 1 to 4. The results are given in Table 5.

TABLE 5

| Bath | Substrate | Sn—Pb eutectoid Maximum wetting force Fmax mN | End wetting force Fend mN | Zero cross time T0 sec | Wetting force time T1 sec | Stability Sb % | Sn—Ag—Cu Maximum wetting force Fmax mN | End wetting force Fend mN | Zero cross time T0 sec | Wetting force time T1 sec | Stability Sb % |
|---|---|---|---|---|---|---|---|---|---|---|---|
| Example 1 (Ag; +0.1% Gd) | Iron-based substrate | 2.969 | 2.969 | 0.38 | 0.62 | 100 | 2.987 | 2.987 | 0.61 | 0.71 | 100 |
| | Copper-based substrate | 2.965 | 2.965 | 0.36 | 0.59 | 100 | 2.981 | 2.981 | 0.58 | 0.73 | 100 |
| Example 2 (Ag + 0.3% Gd) | Iron-based substrate | 2.976 | 2.976 | 0.37 | 0.62 | 100 | 3.018 | 3.018 | 0.59 | 0.77 | 100 |
| | Copper-based substrate | 2.970 | 2.970 | 0.36 | 0.60 | 100 | 3.014 | 3.014 | 0.58 | 0.75 | 100 |
| Example 3 (Ag + 54% Gd) | Iron-based substrate | 3.027 | 3.027 | 0.37 | 0.64 | 100 | 3.135 | 3.135 | 0.61 | 0.78 | 100 |
| | Copper-based substrate | 3.013 | 3.013 | 0.35 | 0.61 | 100 | 3.126 | 3.126 | 0.59 | 0.76 | 100 |
| Comparative Example 1 (solo Ag) | Copper-based substrate | 2.174 | 2.136 | 1.26 | 2.03 | 98.2 | 2.204 | 2.187 | 1.89 | 2.36 | 99.2 |
| Comparative Example 2 (Ag + 0.01% Gd) | Copper-based substrate | 2.486 | 2.486 | 1.05 | 1.68 | 99.2 | 2.516 | 2.495 | 1.68 | 2.18 | 99.2 |
| Comparative Example 3 (Ag + 60% Gd) | Copper-based substrate | 2.748 | 2.748 | 0.62 | 0.99 | 100 | 2.811 | 2.811 | 0.96 | 1.25 | 100 |
| Comparative Example 4 (solo Au) | Iron-based substrate | 3.108 | 3.108 | 0.33 | 0.54 | 100 | 3.119 | 3.119 | 0.50 | 0.65 | 100 |
| | Copper-based substrate | 3.100 | 3.100 | 0.33 | 0.53 | 100 | 3.113 | 3.113 | 0.49 | 0.65 | 100 |

*Sn—Pb eutectoid = 60%-40%

*Sn—Ag—Cu = 96.5%-3%-0.5% (M705, manufactured by Senju Metal Industry Co., Ltd.)

As shown in Table 5, Examples 1 to 3 of the present invention showed a wettability comparable to that of gold-plated coating (Comparative Example 4) for both the lead-based solder (tin-lead eutectoid solder) and the lead-free solder (tin-silver-copper solder).

The invention claimed is:

1. A method for electrolytic plating to deposit a silver-containing alloy on the surface of a substrate, comprising:
immersing the substrate in a plating bath; and
applying an electric field to the substrate, wherein the plating bath contains:
(a) a silver compound containing 99.7% to 60% by mass of silver on the basis of total metal mass therein;
(b) a gadolinium compound containing 0.3% to 40% by mass of gadolinium on the basis of total metal mass therein;
(c) at least one complexing agent; and
(d) a solvent.

2. The method according to claim 1, wherein the silver compound contains 99.7% to 70% by mass of silver on the basis of total metal mass therein and the gadolinium compound contains 0.3% to 30% by mass of gadolinium on the basis of total metal mass therein.

3. A method for electrolytic plating to deposit a silver-containing alloy on the surface of a substrate, comprising:
immersing the substrate in a plating bath; and
applying an electric field to the substrate, wherein the plating bath contains:
(a) a silver compound containing 99.7% to 50% by mass of silver on the basis of total metal mass therein;
(b) a gadolinium compound containing 0.3% to 50% by mass of gadolinium on the basis of total metal mass therein;
(c) at least one complexing agent; and
(d) a solvent,
wherein the total metal mass of the plating bath consists of the silver and the gadolinium.

4. A method for electrolytic plating to deposit a silver-containing alloy on the surface of a substrate, comprising:
immersing the substrate in a plating bath; and
applying an electric field to the substrate, wherein the plating bath consists of:
(a) a silver compound containing 99.7% to 50% by mass of silver on the basis of total metal mass therein;
(b) a gadolinium compound containing 0.3% to 50% by mass of gadolinium on the basis of total metal mass therein;
(c) at least one complexing agent;
(d) a solvent;
and optionally one or more additives selected from the group consisting of surfactant, stabilizer, gloss agent, semi-gloss agent, antioxidant, and pH adjustor.

5. An electrolytic plating bath to deposit a silver-containing alloy on the surface of a substrate, containing:
(a) a silver compound containing 99.7% to 60% by mass of silver on the basis of total metal mass therein;
(b) a gadolinium compound containing 0.3% to 40% by mass of gadolinium on the basis of total metal mass therein;
(c) at least one complexing agent; and
(d) a solvent.

6. The electrolytic plating bath according to claim 5, wherein the silver compound contains 99.7% to 70% by mass of silver on the basis of total metal mass therein and the gadolinium compound contains 0.3% to 30% by mass of gadolinium on the basis of total metal mass therein.

7. An electrolytic plating bath to deposit a silver-containing alloy on the surface of a substrate, containing:
(a) a silver compound containing 99.7% to 50% by mass of silver on the basis of total metal mass therein;
(b) a gadolinium compound containing 0.3% to 50% by mass of gadolinium on the basis of total metal mass therein;
(c) at least one complexing agent; and
(d) a solvent,
wherein the total metal mass of the plating bath consists of the silver and the gadolinium.

8. An electrolytic plating bath to deposit a silver-containing alloy on the surface of a substrate, consisting of:
(a) a silver compound containing 99.7% to 50% by mass of silver on the basis of total metal mass therein;
(b) a gadolinium compound containing 0.3% to 50% by mass of gadolinium on the basis of total metal mass therein;
(c) at least one complexing agent;
(d) a solvent;
and optionally one or more additives selected from the group consisting of surfactant, stabilizer, gloss agent, semi-gloss agent, antioxidant, and pH adjustor.

* * * * *